US006828921B2

(12) United States Patent
Brown et al.

(10) Patent No.: US 6,828,921 B2
(45) Date of Patent: Dec. 7, 2004

(54) DATA LINK CLEARANCE MONITORING AND PILOT ALERT SUB-SYSTEM (COMPASS)

(75) Inventors: John A. Brown, Snohomish, WA (US); Bradley D. Cornell, Lake Stevens, WA (US)

(73) Assignee: The Boeing Company, Chicago, IL (US)

( * ) Notice: Subject to any disclaimer, the term of this patent is extended or adjusted under 35 U.S.C. 154(b) by 214 days.

(21) Appl. No.: 10/007,068

(22) Filed: Dec. 5, 2001

(65) Prior Publication Data

US 2003/0193408 A1 Oct. 16, 2003

(51) Int. Cl.[7] ..... G08B 21/00
(52) U.S. Cl. ..... 340/945; 704/4; 704/120
(58) Field of Search ..... 340/945, 970, 340/961; 701/9, 14, 4, 120, 301

(56) References Cited

U.S. PATENT DOCUMENTS

| | | | | |
|---|---|---|---|---|
| 3,775,767 | A | 11/1973 | Fielding | |
| 4,706,198 | A | 11/1987 | Thurman | |
| 5,025,382 | A | 6/1991 | Artz | |
| 5,111,400 | A | 5/1992 | Yoder | |
| 5,351,194 | A | 9/1994 | Ross et al. | |
| 5,420,582 | A | 5/1995 | Kubbat et al. | |
| 5,659,475 | A | 8/1997 | Brown | |
| 5,714,948 | A | 2/1998 | Farmakis et al. | |
| 5,798,726 | A | 8/1998 | Schuchman et al. | |
| 5,872,526 | A | 2/1999 | Tognazzini | |
| 6,002,347 | A | 12/1999 | Daly et al. | |
| 6,160,497 | A | 12/2000 | Clark | |
| 6,175,314 | B1 * | 1/2001 | Cobley | 340/945 |
| 6,567,727 | B2 * | 5/2003 | Westphal | 701/4 |
| 6,594,578 | B2 * | 7/2003 | Lai | 701/120 |
| 6,604,044 | B1 * | 8/2003 | Kirk | 701/120 |

FOREIGN PATENT DOCUMENTS

| | | |
|---|---|---|
| WO | WO 0041153 | 7/2000 |

* cited by examiner

*Primary Examiner*—John Tweel

(57) ABSTRACT

A Data Link Clearance Alerting System is enabled, either manually or automatically, as soon as the flight crew establishes a data link connection with air traffic control. Once a connection is established, the system stores each ATC clearance that has been positively acknowledged, and accepted, by the crew. The system monitors the aircraft in relation to the clearance. An alert is provided to the flight crew as soon as, in some cases just prior to, the airplane is not in compliance with a clearance. In addition, an alert is provided when estimates (e.g. estimated time of arrival at a point) or intent data passed to ATC by data link communication or data link surveillance systems no longer reflect the aircraft's predicted flight path.

5 Claims, 1 Drawing Sheet

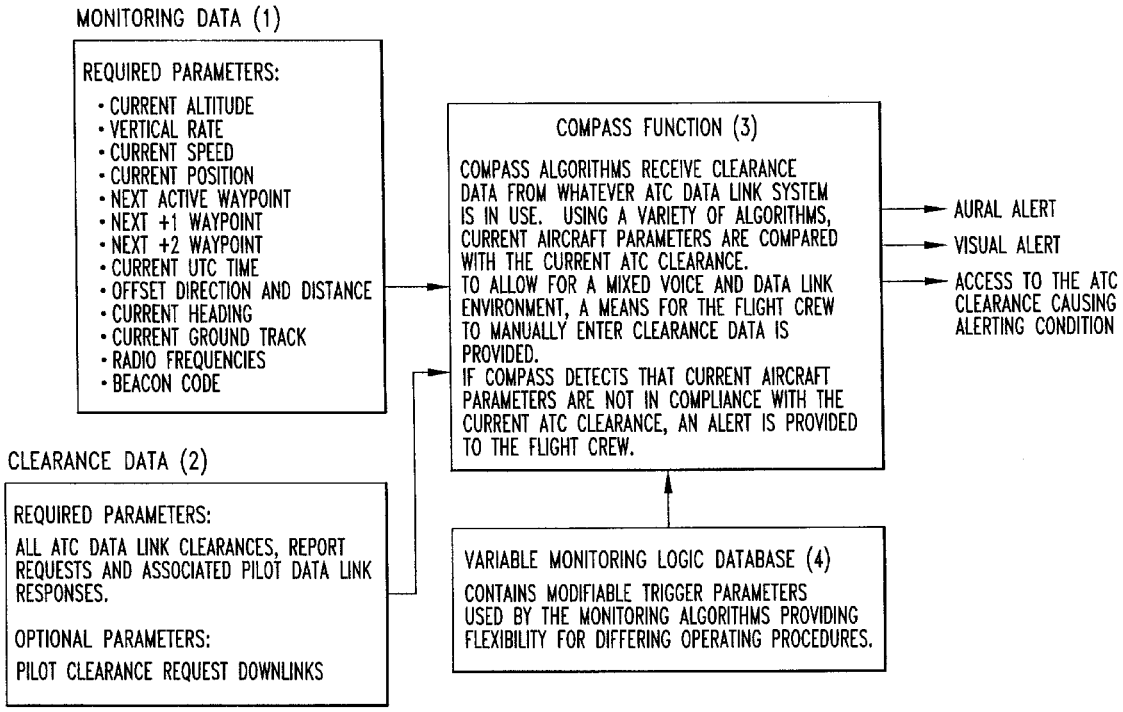

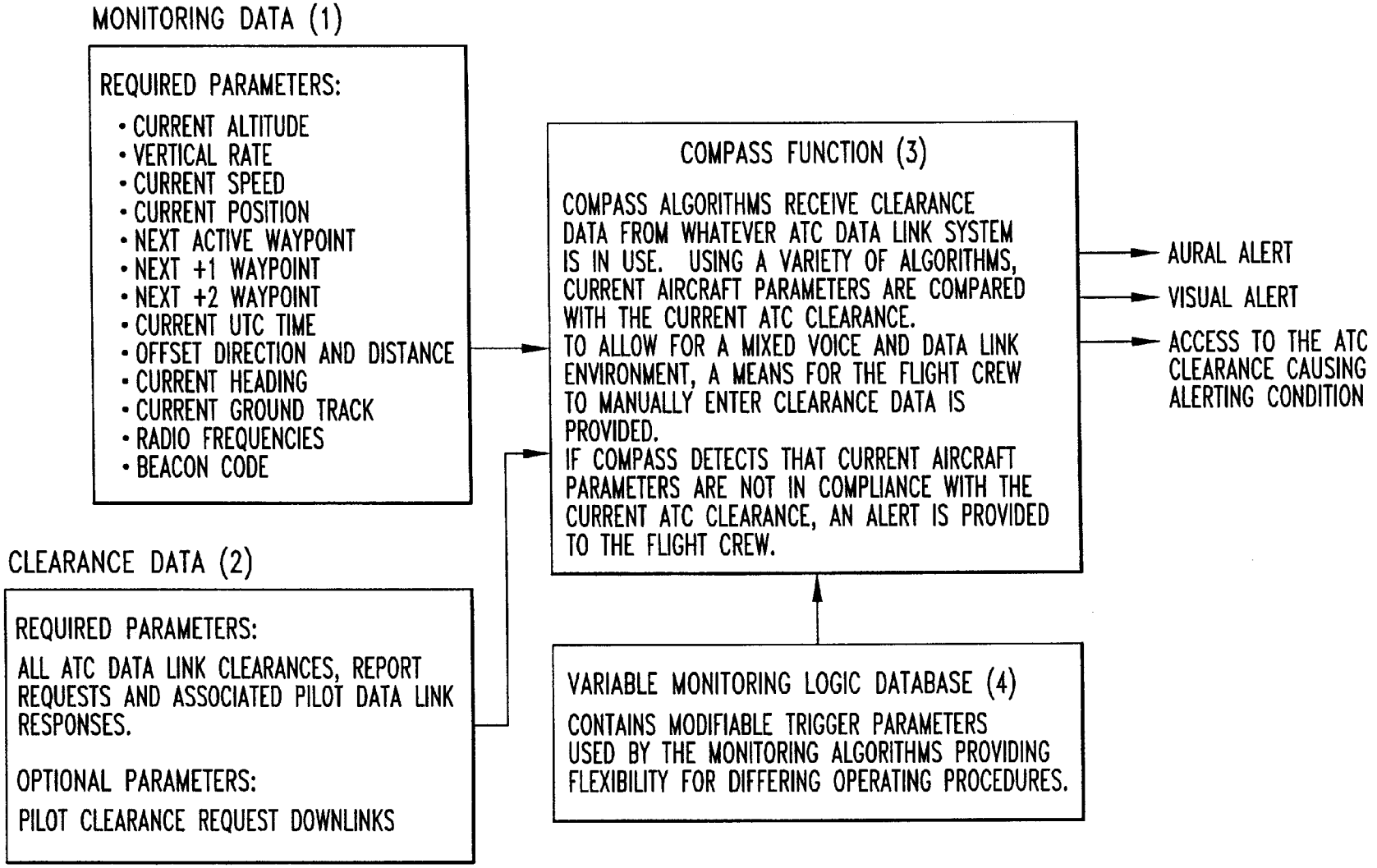
MONITORING DATA (1)
REQUIRED PARAMETERS:
• CURRENT ALTITUDE
• VERTICAL RATE
• CURRENT SPEED
• CURRENT POSITION
• NEXT ACTIVE WAYPOINT
• NEXT +1 WAYPOINT
• NEXT +2 WAYPOINT
• CURRENT UTC TIME
• OFFSET DIRECTION AND DISTANCE
• CURRENT HEADING
• CURRENT GROUND TRACK
• RADIO FREQUENCIES
• BEACON CODE
CLEARANCE DATA (2)
REQUIRED PARAMETERS:
ALL ATC DATA LINK CLEARANCES, REPORT REQUESTS AND ASSOCIATED PILOT DATA LINK RESPONSES.
OPTIONAL PARAMETERS:
PILOT CLEARANCE REQUEST DOWNLINKS
COMPASS FUNCTION (3)
COMPASS ALGORITHMS RECEIVE CLEARANCE DATA FROM WHATEVER ATC DATA LINK SYSTEM IS IN USE. USING A VARIETY OF ALGORITHMS, CURRENT AIRCRAFT PARAMETERS ARE COMPARED WITH THE CURRENT ATC CLEARANCE.
TO ALLOW FOR A MIXED VOICE AND DATA LINK ENVIRONMENT, A MEANS FOR THE FLIGHT CREW TO MANUALLY ENTER CLEARANCE DATA IS PROVIDED.
IF COMPASS DETECTS THAT CURRENT AIRCRAFT PARAMETERS ARE NOT IN COMPLIANCE WITH THE CURRENT ATC CLEARANCE, AN ALERT IS PROVIDED TO THE FLIGHT CREW.
VARIABLE MONITORING LOGIC DATABASE (4)
CONTAINS MODIFIABLE TRIGGER PARAMETERS USED BY THE MONITORING ALGORITHMS PROVIDING FLEXIBILITY FOR DIFFERING OPERATING PROCEDURES.
AURAL ALERT
VISUAL ALERT
ACCESS TO THE ATC CLEARANCE CAUSING ALERTING CONDITION

DATA LINK CLEARANCE MONITORING AND PILOT ALERT SUB-SYSTEM (COMPASS)

FIELD OF THE INVENTION

The present invention generally relates to air traffic control, and, more particularly to a method and apparatus for determining if clearance has been complied with.

BACKGROUND OF THE INVENTION

A clear understanding between pilot and controller of the assigned clearance is essential for safe and efficient operations. Since the inception of radio communication, the aviation community has taken several steps to limit the possibility for misunderstandings by the use of standard operating procedures and phraseology wherever possible. Even so, there have been incidents where the flight crew's failure to comply with an air traffic control clearance has occurred. Monitoring aircraft parameters to ensure adherence to ATC instructions is one of the flight crew's primary responsibilities. Many crews write down ATC clearances on paper to help them remember. As an aid to the pilot, in the early 60s, several aircraft manufacturers added an altitude alerting function. The function alerts the flight crew if the aircraft's actual altitude deviates from the altitude set by the pilot. Even though this system only monitors one parameter and is manually set, the system has proven itself useful in helping to reduce altitude clearance violations.

Data link technology is now being used between flight crews and controllers to exchange messages to request and respond to clearances, and to send ATC-requested reports. This form of communication is expected to increase in the future as airspace becomes more crowded. In addition to clearance communication, ATC is also using data link technology for surveillance enabling easier detection of clearance violations outside of radar coverage. Although a relatively small number of aircraft use data link technology today, in the future, almost all aircraft will use some form of data link for ATC communication. However, as airspace congestion increases, strict adherence to ATC clearances will become even more essential if current safety standards are to be maintained.

Data link technology as described hereinafter can be used as an enabler to develop a new and comprehensive monitor function that can reduce crew workload and reduce airline operating costs by reducing the number of clearance violations. The present system stores data linked clearance information and monitors aircraft performance with respect to the assigned clearance alerting flight crews to a clearance violation. In some cases in the present system the flight crew can be alerted prior to a potential violation. In other cases the flight crew will be alerted as soon as the violation occurs. The hereinafter described system according to the present invention comprises a Compliance Monitor and Pilot Alerting Sub-System (COMPASS).

BRIEF SUMMARY OF THE INVENTION

COMPASS Overview

A prerequisite of the present COMPASS system is the capability to communicate with ATC via data link communication. Currently there are two protocol standards for ATC data link communication and there may be others in the future. The basic operating concept behind the COMPASS system centers on the use of ATC clearance information contained in ATC data link messages combined with COMPASS monitoring logic; it is thus protocol independent. To accommodate a wide range of avionic architectures, COMPASS can be implemented as a software function, or as a separate LRU that receives clearance information from other data link systems.

ATC clearance data is automatically entered into the system from uplink clearances accepted by the flight crew. The system monitors aircraft parameters to determine if the clearance is being complied with as pilots do manually. If the system determines the aircraft is about to violate, or is in violation of an ATC clearance or report request, the system alerts the pilot.

BRIEF DESCRIPTION OF THE DRAWING

FIG. 1 is a block diagram of the present Compliance Monitor and Pilot Alerting Sub-System (COMPASS)

DESCRIPTION OF THE PREFERRED EMBODIMENT

Block Diagram

FIG. 1 is illustrative of an exemplary COMPASS system. ATC clearance data is automatically entered into the system from uplink clearances accepted by the flight crew. The system monitors aircraft parameters to determine if the clearance is being complied with in much the same way the pilots do manually. If the system determines the aircraft is about to violate, or is in violation of an ATC clearance or report request, the system alerts the pilot. COMPASS components comprise the following:

Monitoring Data (1)

COMPASS monitoring algorithms use data parameters available from several aircraft systems to monitor clearance compliance.

Clearance Data (2)

COMPASS uses ATC clearance data that is data linked to the aircraft and accepted by the flight crew as a basis for compliance monitoring.

COMPASS Function (3)

COMPASS uses unique monitoring algorithms for individual and combined clearances. Monitoring algorithms use Monitoring Data (item 1 in the block diagram) to determine if the aircraft is in compliance with accepted ATC clearances.

Variable Monitoring Logic Database (4)

The Variable Monitoring Logic Database (VMLDB) stores trigger logic variables used by the COMPASS monitoring algorithms. The VMLDB architecture provides flexibility within COMPASS and allows for customization to accommodate different airline operations and operating techniques while still providing the clearance monitoring function.

Output (5)

COMPASS provides aural and visual alerts to inform the flight crew of a potential or actual clearance violation.

COMPASS also provides the flight crew with easy access to the ATC clearance that is causing the alerting condition.

System Description

Compliance Monitor and Pilot Alerting Sub-System (COMPASS)

Operating Philosophy

The COMPASS is primarily suited to operations in airspace where data link is the primary means of communication for routine clearance instructions. However manual updating may be required to accommodate non-normal operations (voice communications) and will be provided for. The system can be activated or deactivated by the flight crew at any time. Today data link communication is used throughout the Pacific oceanic region and is spreading rapidly to other regions. By 2003, a majority of procedural controlled airspace will offer ATC data link services. Industry is also promoting the use of ATC data link communications in domestic airspace for routine clearance communications. Trials are currently being conducted in Europe and are scheduled for US domestic operations in 2001.

When COMPASS is active, the most recent clearances, either captured from data link or entered manually, are stored and monitored by the system. Each subsequent clearance is evaluated, and if required, monitored by the system as appropriate.

Upon full implementation, the present system is directed to achieving the following operational benefits:

- Enhances safety by reducing operational errors
- Reduces certificate action against pilots by reducing operational violations resulting from pilot error
- Reduces fines imposed on operators as a result of operational violations by reducing pilot error
- Supports aircraft separation reduction by reducing the risk of collisions between aircraft
- Increases airspace capacity by supporting aircraft separation reduction
- Reduces delay by supporting increases in airspace capacity
- Reduces air traffic controller workload by alerting the pilot to deviations from assigned trajectories before ADS conformance monitoring parameters are exceeded
- Improves operating efficiency by supporting separation reductions that allow use of more efficient routes and operating procedures
- Alerts pilots to non-compliance with clearances if alerts cannot be issued prior to achieving lack of compliance
- Alerts pilots who respond with incorrect input to data link clearances
- Alerts pilots who do not maneuver in response to clearances
- Alerts pilots who maneuver too early in response to data link clearances which are deferred until a time or position
- Alerts pilots who do not maintain parameters (e.g. altitude) in clearances once the clearance is followed
- Alerts pilots if aircraft's current performance will not allow it to comply with a clearance
- Alerts pilots if the appropriate automation mode to achieve cleared maneuvers is not engaged
- Does not alert pilots if the clearance is subsequently changed by another data link clearance
- Accommodates voice amendments to data link clearances by providing a manual input capability
- Accommodates varying operating techniques by providing the user with the opportunity easily to set trigger parameters and exclude functions In some cases the system can alert the flight crew before a clearance is violated. In other cases, the system will alert the flight crew as soon as a clearance violation occurs, which is similar in operation to today's altitude-alerting function. The intent of the system is to give the pilot the maximum notice of non-compliance, usually prior to parametric triggers that may signal non-conformance to ATC.

Features provided by COMPASS would provide value using today's separation standards and will become increasingly valuable as traffic increases and separations are reduced. The value to an airline would be realized by reduced operating costs associated with investigations and litigation due to flight crew clearance violations. As separations are reduced and the frequency of complex conditional clearances increases, flight crew clearance violations are likely to increase if a clearance monitoring function is not provided. Ultimately, equipage with such a monitoring function might be a requirement for separation reductions.

Clearance Monitor and Alerting Logic

The COMPASS logic provided below is specific to the FANS 1 message set which is widely used in service today. Other message sets, such as the Aeronautical Telecommunications Network (ATN), would require additional message logic since some messages are unique to that message set. However, all the same principals would apply. In many cases the same logic could be used between FANS and ATN.

The logic is designed to prevent clearance violations where possible. Where preventative alerts cannot be provided, the flight crew is alerted as soon as the clearance is violated. Immediate awareness of a clearance violation can in most cases prevent, and in other cases greatly reduce, the severity of a clearance violation and its consequences. In some cases immediate awareness by the flight crew can prevent a controller from filing a violation.

One of the innovative features of COMPASS is the use of a Variable Monitoring Logic DataBase (VMLDB). The VMLDB stores trigger logic variables used by the COMPASS monitoring algorithms. This architecture provides flexibility and allows for customization to accommodate different airline operations and operating techniques while still providing the clearance monitoring function. As an example, if a particular operator did not want to provide pre-violation alerts, the VMLBD could be customized to deactivate all, or any subset of, pre-alerts.

Once initialized all subsequent clearances are monitored; clearances that supersede preceding clearances that have set alert triggers will cancel the existing associated triggers and set new triggers. If multiple clearance elements are received the triggers defined for individual clearance elements are combined providing coverage for the entire clearance as appropriate.

All logic is applied at the time each uplink is accepted by the flight crew. Some logic statements include delay statements. All delay counters start at time of message acceptance by the flight crew.

Each exceedance of an alert trigger results in the pilot's being alerted. The alert function also provides single keypress access to the clearance that is being violated.

Vertical Clearances

| | |
|---|---|
| 6 | EXPECT [altitude] |
| 7 | EXPECT CLIMB AT [time] |
| 8 | EXPECT CLIMB AT [position] |
| 9 | EXPECT DESCENT AT [time] |
| 10 | EXPECT DESCENT AT [position] |
| 11 | EXPECT CRUISE CLIMB AT [time] |
| 12 | EXPECT CRUISE CLIMB AT [position] |
| 13 | AT [time] EXPECT CLIMB TO [altitude] |
| 14 | AT [position] EXPECT CLIMB TO [altitude] |
| 15 | AT [time] EXPECT DESCENT TO [altitude] |
| 16 | AT [position] EXPECT DESCENT TO [altitude] |
| 17 | AT [time] EXPECT CRUISE CLIMB TO [altitude] |
| 18 | AT [position] EXPECT CRUISE CLIMB TO [altitude] |

All are clearance expectations. Although these messages are included in the FANS message set, air traffic controllers are discouraged from using them since they may cause confusion and might induce crews to follow the "expect" message. Expectation messages are not monitored by COMPASS since no expect message can cause a violation. Alert triggers set by any preceding vertical clearance will protect the pilot.

| | |
|---|---|
| 19 | MAINTAIN [altitude] |

It is assumed that this instruction will not be used unless current altitude equals cleared altitude; however, allowance is made for receipt of the instruction in other conditions. System notes the altitude specified in the "maintain" instruction and monitors current altitude, current vertical speed, MCP altitude and vertical speed selected values, and all vertical autopilot mode selections.

If current altitude equals the specified altitude, the system monitors the autopilot Mode Control Panel altitude and current altitude and vertical speed. If the MCP altitude is changed or a vertical speed in excess of X feet per minute (X is defined in the VMLDB) is sensed, the system alerts the pilot.

Function Disarmed as Follows:

On single pilot cancellation following alert activation.

On pilot disarm selection at any time.

| | |
|---|---|
| 20 | CLIMB TO AND MAINTAIN [altitude] |
| 23 | DESCEND TO AND MAINTAIN [altitude] |

It is assumed that these instructions might be given during climb or descent and could result in reversal of vertical path (i.e. a climb instruction could be given when the aircraft is descending). System notes altitude in this vertical clearance and time at which the clearance was accepted; it then monitors current altitude, current time, current vertical speed, and MCP altitude.

If the altitude in the "climb/descend and maintain" instruction is different from the altitude in the MCP, and the MCP altitude is not changed to the altitude in the "climb/descend and maintain" instruction within X seconds after acceptance of the instruction, the system alerts the pilot.

If current altitude is different from the assigned altitude, and the aircraft's vertical rate is less than X feet per minute (X is defined in the VMLDB but is not less than 500 feet per minute) in the direction that will result in altitude capture at the assigned altitude and altitude capture at the assigned altitude has not been entered, the pilot will be alerted after X seconds (X is defined in the VMLDB database).

Once the altitude in the "climb/descend and maintain" instruction has been reached for X seconds (X is defined in the VMLDB), if the altitude in the MCP is changed the system alerts the pilot.

If a vertical rate in excess of X feet per minute (X is defined in the VMILDB) in the wrong direction is detected, the system alerts the pilot.

Once the specified altitude has been maintained for X seconds (X is defined in the VMLDB), the system monitors the autopilot Mode Control Panel altitude and current altitude. If the MCP altitude is changed or a vertical speed in excess of X feet per minute (X is defined in the VMLDB) is sensed, the system alerts the pilot.

Function Disarmed as Follows:

On single pilot cancellation following alert activation.

On pilot disarm selection at any time.

| | |
|---|---|
| 21 | AT [time] CLIMB TO AND MAINTAIN [altitude] |
| 22 | AT [position] CLIMB TO AND MAINTAIN [altitude] |
| 24 | AT [time] DESCEND TO AND MAINTAIN [altitude] |
| 25 | AT [position] DESCEND TO AND MAINTAIN [altitude] |

This monitoring logic is designed to prevent premature response to clearances, which do not become effective until a position is reached or until a stated time. The function also prompts the pilot to comply with the deferred clearance if action is not taken at the appropriate position/time. System notes the altitude, position, and time in the clearance and monitors current time, current geographical position, MCP altitude, and subsequent vertical clearances. Where appropriate, the system extracts latitude/longitude data related to waypoint names from its navigation data base and uses aircraft track to interpret when the aircraft passes abeam the position rather than directly over it.

If the MCP altitude selection is changed before the position in the message is passed or before the time stated in the message, as applicable, the system alerts the pilot. If the message is received when the aircraft is operating in a block of altitudes assigned by a previous clearance, no alert will result from changes in MCP altitude unless the change is to an altitude outside the assigned block of altitudes. If the MCP altitude is changed to an altitude outside the assigned block of altitudes, then the logic above will apply.

The pilot will be alerted X seconds(s) (X is defined in the VMLDB) after the aircraft passes the position stated in the clearance or after the time stated in the clearance, as applicable, unless the MCP altitude is reset to the altitude stated in the clearance and current vertical speed is greater than X feet per minute (X is defined in the VMLDB) in the direction that will cause the aircraft to attain the cleared altitude.

Once the aircraft has passed (abeam) the position stated in the clearance or after the time stated in the clearance, as appropriate, and the pilot has initiated an appropriate change in altitude, the system alerts the pilot if the vertical rate falls below X feet per minute (X is defined in the VMLDB but is not less than 500 feet per minute) before altitude capture has been initiated. After the aircraft has passed (abeam) the position stated in the clearance or after the time stated in the clearance, as appropriate, if a vertical rate in the wrong direction is detected, the system alerts the pilot.

Once the specified altitude has been maintained for X seconds (X is defined in the VMLDB), the system monitors the autopilot Mode Control Panel altitude and current vertical sped. If the MCP altitude is changed or a vertical speed in excess of X feet per minute (X is defined in the VMLDB) is sensed, the system alerts the pilot.

Function Disarmed as Follows:

On single pilot cancellation following alert activation.

On pilot disarm selection at any time.

| | |
|---|---|
| 26 | CLIMB TO REACH [altitude] BY [time] |
| 27 | CLIMB TO REACH [altitude] BY [position] |
| 28 | DESCEND TO REACH [altitude] BY [time] |
| 29 | DESCEND TO REACH [altitude] BY [position] |

These clearances allow pilots to choose when to start the vertical rate change, either a climb or descent, in order to meet the assigned altitude constraint.

The system notes cleared altitude and altitude constraint position or time, as appropriate. In addition, the system monitors current position, current time, current altitude, and current ETA at the stated position if appropriate. Where appropriate, the system extracts latitude/longitude data related to waypoint names from its navigation data base and uses aircraft track to interpret when the aircraft passes abeam the position rather than directly over it.

If the aircraft cannot reach the assigned altitude at a vertical rate of X feet per minute (X is defined in the VMLDB) by the time stated in the clearance or current ETA at the stated position, the system alerts the pilot.

If time to climb to altitude is estimated to be greater than X seconds (X is defined in the VMLDB), and the condition above persists for a period in excess of that time, the alert is repeated.

If the aircraft has not attained the assigned altitude when it passes (abeam) the stated position or by the time stated in the clearance, as appropriate, the system alerts the pilot.

Once the specified altitude has been maintained for X seconds minute (X is defined in the VMLDB), the system monitors the autopilot Mode Control Panel altitude and current vertical speed. If the MCP altitude is changed or a vertical speed in excess of X feet per minute (X is defined in the VMLDB) is sensed, the system alerts the pilot.

Function Disarmed as Follows:

On single pilot cancellation following alert activation on passing (abeam) the position or by the stated time.

On pilot disarm selection at any time.

| | |
|---|---|
| 30 | MAINTAIN BLOCK [altitude] TO [altitude] |

It is assumed that this instruction will not be used unless current altitude lies within the assigned block; however, allowance is made for receipt of the instruction in other conditions. System notes the upper and lower altitudes in the "maintain block" instruction and monitors current altitude, current vertical speed, MCP altitude, current time, and subsequent vertical clearances.

If the aircraft is within the specified block, the system will alert the pilot if MCP altitude is set to a value outside the block or a vertical speed in excess of that which will take the aircraft outside the assigned block within X seconds (X is defined in the VMLDB) is sensed.

If the aircraft is outside the assigned block and the MCP altitude is not set to an altitude within the specified block within X seconds (X is defined in the VMLDB), the system alerts the pilot.

If current altitude is outside the specified block and the aircraft's vertical rate is less than X feet per minute (X is defined in the VMLDB) in the direction that will result in the aircraft's entering the specified block, the pilot will be alerted X seconds (X is defined in the VMLDB).

Function Disarmed as Follows:

On single pilot cancellation following alert activation after the aircraft enters the assigned altitude block.

On pilot disarm selection at any time.

| | |
|---|---|
| 31 | CLIMB TO AND MAINTAIN BLOCK [altitude] TO [altitude] |
| 32 | DESCEND TO AND MAINTAIN BLOCK [altitude] TO [altitude] |

It is assumed that these instructions might be given during climb or descent and could result in reversal of vertical path (i.e. a climb instruction could be given when the aircraft is descending). System notes altitudes in this vertical clearance, and monitors current altitude, current vertical speed, MCP altitude, current time and subsequent vertical clearances.

If the MCP altitude is outside the specified block and the MCP altitude is not changed to an altitude within the specified block within X seconds (X is defined in the VMLDB) after acceptance of the instruction, the system alerts the pilot.

After the clearance is accepted, if a vertical rate in the wrong direction is detected, the system alerts the pilot.

If current altitude is outside the specified block and the aircraft's vertical rate is less than X feet per minute (X is defined in the VMLDB) in the direction that will result in the aircraft's entering the specified block, the system alerts the pilot after X seconds (X is defined in the VMLDB).

Function Disarmed as Follows:

On single pilot cancellation following alert activation.

On pilot disarm selection at any time.

| | |
|---|---|
| 33 | CRUISE [altitude] |

This clearance allows the pilot to descend to the assigned altitude in the clearance, but descent time is at the pilot's discretion and the aircraft is permitted to climb and descend as required, but not above the previously assigned altitude. System notes assigned altitude at the time when the message was accepted (if a previous altitude clearance was received by data link or entered into the system manually; otherwise system notes MCP altitude at the time cruise clearance was received) and assigned altitude in the message. The system monitors current altitude, and MCP altitude.

If MCP altitude is set above previously assigned altitude or below newly assigned altitude in the "cruise" clearance, the system alerts the pilot.

If current altitude is above previously assigned altitude by more than X feet or below newly assigned altitude by more than X feet (X is defined in the VMLDB), the system alerts the pilot.

Function Disarmed as Follows:

On pilot disarm selection at any time.

| | |
|---|---|
| 34 | CRUISE CLIMB TO [altitude] |

This clearance allows the pilot to climb to the assigned altitude at rates that would normally be too low to be acceptable; descents are also permitted, but not below the previously assigned altitude. System notes assigned altitude at the time when the message was accepted (if no data link or manual entry, the system uses MCP altitude at time that message was received) and assigned altitude in the message. The system monitors current altitude, MCP altitude, and subsequent vertical clearances.

If MCP altitude is set below previously assigned altitude or above newly assigned altitude in the "cruise" clearance, the pilot will be alerted.

If current altitude is below previously assigned altitude by more than X feet or above newly assigned altitude by more than X feet (X is defined in the VMLDB), the system alerts the pilot.

Function Disarmed as Follows:

On pilot disarm selection at any time.

| | |
|---|---|
| 35 | CRUISE CLIMB ABOVE [altitude] |

This clearance requires that the pilot climb to the altitude assigned at normal vertical rates but above that altitude, climb rate can be very low or descents can be performed, but not below the assigned altitude. System notes assigned altitude in the message and time at which the clearance was accepted. The system monitors current altitude, MCP altitude, vertical speed, current time, aircraft flight control system vertical modes, and subsequent vertical clearances.

If the altitude in the "cruise" clearance is higher than the current altitude, and the MCP altitude is not changed to an altitude at or above assigned altitude within X seconds (X is defined in the VMLDB) after acceptance of the instruction, the system alerts the pilot.

If current altitude is lower than the altitude in the instruction and the aircraft's climb rate is less than X feet per minute (X is defined in the VMLDB but not less than 500 feet per minute), the system alerts the pilot after X seconds (X is defined in the VMLDB). This function is disarmed when the aircraft's flight control system enters the altitude capture mode at the assigned altitude or above.

If, after reaching/passing the assigned altitude, the MCP altitude is set below the assigned altitude, the system alerts the pilot.

If, after reaching/passing the assigned altitude, the current altitude is below assigned altitude by more than X feet (X is defined in the VMLDB), the system alerts the pilot.

Function Disarmed as Follows:

On pilot disarm selection at any time.

| | |
|---|---|
| 6 | EXPEDITE CLIMB TO [altitude] |
| 37 | EXPEDITE DESCENT TO [altitude] |

This clearance directs the pilot to increase rate of climb/descend to the assigned altitude; however, accommodation is made for the instruction's being received while the aircraft is in level flight. The system notes assigned altitude and monitors current altitude, vertical speed.

If the aircraft is not at the assigned altitude and a vertical rate in excess of X feet per minute (X is defined in the VMLDB) has not been achieved in the direction of the assigned altitude within X seconds (X is defined in the VMLDB), the system alerts the pilot.

If the current altitude does not equal the assigned altitude within X seconds (X is defined in the VMLDB), the system alerts the pilot.

If the aircraft is not at the assigned altitude and MCP altitude is not set to the assigned altitude within X seconds (X is defined in the VMLDB), the system alerts the pilot.

Once the specified altitude has been maintained for X seconds minute (X is defined in the VMLDB), the system monitors the autopilot Mode Control Panel altitude and current vertical speed. If the MCP altitude is changed or a vertical speed in excess of X feet per minute (X is defined in the VMLDB) is sensed, the system alerts the pilot.

Function Disarmed as Follows:

On pilot disarm selection at any time.

| | |
|---|---|
| 38 | IMMEDIATELY CLIMB TO [altitude] |
| 39 | IMMEDIATELY DESCEND TO [altitude] |
| 40 | IMMEDIATELY STOP CLIMB AT [altitude] |
| 41 | IMMEDIATELY STOP DESCENT AT [altitude] |

This clearance directs the pilot to climb/descend immediately to the assigned altitude or to stop climbing/descending at the assigned altitude. The system notes assigned altitude and monitors current altitude MCP altitude and vertical speed.

For climb/descent cases, if a vertical speed in excess of X feet per minute (X is defined in the VMLDB) has not been achieved in the direction of the assigned altitude within X seconds (X is defined in the VMLDB), the system alerts the pilot.

After the clearance is accepted, if a vertical rate in the wrong direction is detected, the system alerts the pilot.

If the current altitude does not equal the assigned altitude within X seconds (X is defined in the VMLDB), the system alerts the pilot.

For stop climb/descent cases, if the MCP altitude is not set to the assigned altitude or the altitude hold mode is not entered to level the aircraft at an altitude within X feet (X is defined in the VMLDB but is not greater than 200 feet) of the assigned altitude, the system alerts the pilot.

Once the specified altitude has been maintained for X seconds minute (X is defined in the VMLDB), the system monitors the autopilot Mode Control Panel altitude and current vertical speed. If the MCP altitude is changed or a vertical speed in excess of X feet per minute (X is defined in the VMLDB) is sensed, the system alerts the pilot.

Function Disarmed as Follows:

On pilot disarm selection at any time.

| | |
|---|---|
| 171 | CLIMB AT [verticalRate] MINIMUM |
| 173 | DESCEND AT [verticalRate] MINIMUM |

This clearance directs the pilot to climb/descend at a minimum assigned vertical rate; it is assumed that the instruction is received as part of a message that includes a vertical clearance or during a period when a vertical clearance is being satisfied. The system notes the specified vertical speed constraint and the time at which the clearance was accepted and monitors current vertical speed, current time and subsequent vertical clearances.

X seconds (X is defined in the VMLDB) after the "climb at descend at" clearance is accepted, if a vertical rate less than the vertical rate specified is detected for more than Y seconds (Y is defined in the VMLDB), the system alerts the pilot.

If a vertical rate in the wrong direction is detected, the system alerts the pilot.

Function Disarmed as Follows:

On pilot disarm selection at any time.

On reaching the altitude or block in the associated vertical clearance.

| | |
|---|---|
| 172 | CLIMB AT [verticalRate] MAXIMUM |
| 174 | DESCEND AT [verticalRate] MAXIMUM |

This clearance directs the pilot to climb/descend at a maximum assigned vertical rate; it is assumed that the instruction is received as part of a message that includes a vertical clearance or during a period when a vertical clearance is being satisfied. The system monitors current vertical speed and subsequent vertical clearances.

X seconds (X is defined in the VMLDB) after the "climb at/descend at" clearance is accepted, if a vertical rate greater than the vertical rate specified is detected for more than X seconds (X is defined in the VMLDB), the system alerts the pilot.

If a vertical rate in the wrong direction is detected, the system alerts the pilot.

Function disarmed as follows:

On pilot disarm selection at any time.

On reaching the altitude or block in the associated vertical clearance.

| | |
|---|---|
| 42 | EXPECT TO CROSS [position] AT [altitude] |
| 43 | EXPECT TO CROSS [position] AT OR ABOVE [altitude] |
| 44 | EXPECT TO CROSS [position] AT OR BELOW [altitude] |
| 45 | EXPECT TO CROSS [position] AT AND MAINTAIN [altitude] |

All are clearance expectations. Although these messages are included in the FANS message set, ATC controllers are discouraged from using them since they cause confusion and might induce pilots to follow the "expect" message. Expectation messages are not monitored by COMPASS since no expect message can cause a violation.

| | |
|---|---|
| 46 | CROSS [position] AT [altitude] |
| 47 | CROSS [position] AT OR ABOVE [altitude] |
| 48 | CROSS [position] AT OR BELOW [altitude] |
| 49 | CROSS [position] BETWEEN [altitude] AND |
| 50 | [altitude] |

It is assumed that this instruction might be given during climb or descent and could result in reversal of vertical path (i.e. a climb instruction could be given when the aircraft is descending). System notes altitude or altitude band in these crossing constraint clearances, and monitors current altitude, present position, current time, ETA at assigned position, and subsequent vertical clearances.

If the aircraft cannot reach the altitude constraint or altitude band using a vertical speed of X feet per minute or less (X is defined in the VMLDB) the system alerts the pilot.

If the aircraft passes (abeam) the assigned position and is not within X feet of the assigned altitude or altitude band (X is defined in the VMLDB), the system alerts the pilot.

Function Disarmed as Follows:

On pilot disarm selection at any time.

| | |
|---|---|
| 49 | CROSS [position] AT AND MAINTAIN [altitude] |

It is assumed that this instruction might be given during climb or descent and could result in reversal of vertical path (i.e. a climb instruction could be given when the aircraft is descending). System notes altitude and position in this crossing constraint clearance, and monitors current altitude, MCP altitude, vertical speed, current time, ETA at assigned position and subsequent vertical clearances.

If the aircraft cannot reach the altitude constraint using a vertical speed of X feet per minute or less (X is defined in the VMLDB) the system alerts the pilot.

If the aircraft passes the assigned position and is not within X feet of the assigned altitude or altitude band (X is defined in the VMLDB), the system alerts the pilot.

If the current altitude equals the specified altitude and the aircraft has passed the specified position, if MCP altitude is changed, the system alerts the pilot.

If the current altitude equals the specified altitude and the aircraft has passed the specified position, if a vertical rate greater than X feet per minute is sensed (X is defined in the VMLDB), the system alerts the pilot.

Function Disarmed as Follows:

On pilot disarm selection at any time.

| 51 | CROSS [position] AT [time] |
|---|---|

System notes assigned position and assigned time in the crossing constraint clearance, and monitors time, present position, ETA at assigned position, and subsequent clearances that modify the route.

If the ETA at the assigned position is not within X seconds (X is defined in the VMLDB) of the assigned time, system alerts the pilot.

Function disarmed as follows:

On pilot disarm selection at any time.

| 52 | CROSS [position] AT OR BEFORE [time] |
|---|---|

System notes assigned position and assigned time in the crossing constraint clearance, and monitors time, present position, ETA at assigned position, and subsequent clearances that modify the route.

If the ETA at the assigned position is not equal to or before the assigned time, system alerts the pilot.

Function Disarmed as Follows:

On pilot disarm selection at any time.

| 53 | CROSS [position] AT OR AFTER [time] |
|---|---|

System notes assigned position and assigned time in the crossing constraint clearance, and monitors time, present position, ETA at assigned position, and subsequent clearances that modify the route.

If the ETA at the assigned position is not equal to or after the assigned time, system alerts the pilot.

Function Disarmed as Follows:

On pilot disarm selection at any time.

| 54 | CROSS [position] BETWEEN [time] AND [time] |
|---|---|

System notes assigned position and assigned time window in the crossing constraint clearance, and monitors time, present position, ETA at assigned position, and subsequent clearances that modify the route.

If the ETA at the assigned position is not within the assigned time window, system alerts the pilot.

Function Disarmed as Follows:

On pilot disarm selection at any time.

| 55 | CROSS [position] AT [speed] |
|---|---|
| 56 | CROSS [position] AT OR LESS THAN [speed] |
| 57 | CROSS [position] AT OR GREATER THAN [speed] |

The system notes the assigned position and speed in these crossing constraint clearances, and monitors present position, ETA at assigned position, current speed and subsequent clearances that modify the route.

If the aircraft cannot cross the assigned position at the assigned speed or within the assigned speed band without increasing or decreasing speed at more than X knots per second (X is defined in the VMLDB), the system alerts the pilot.

If the aircraft passes (abeam) the assigned position and current speed does not equal the assigned speed plus or minus X knots (X is defined in the VMLDB), the system alerts the pilot.

Function Disarmed as Follows:

On pilot disarm selection at any time.

| 58 | CROSS [position] AT [time] AT [altitude] |
|---|---|

The system notes the assigned position, time, and altitude in this crossing constraint clearance, and monitors present position, ETA at assigned position, current altitude, current time, and subsequent clearances.

If the aircraft cannot cross the assigned position at the assigned altitude at the assigned time without exceeding X feet per minute climb or descent (where X is defined in the VMLDB), the system alerts the pilot.

If the aircraft cannot cross the assigned position at the assigned time without an increase of X knots per second or a decrease of Y knots per second (where X and Y values are defined in the VMLDB), the system alerts the pilot.

If the aircraft passes (abeam) the assigned position at other than the assigned time or assigned altitude, the system alerts the pilot.

Function Disarmed as Follows:

On pilot disarm selection at any time.

| 59 | CROSS [position] AT OR BEFORE [time] AT [altitude] |
|---|---|

The system notes the assigned position, time, and altitude in this crossing constraint clearance, and monitors present position, ETA at assigned position, current altitude, current time and subsequent clearances.

If the aircraft cannot cross the assigned position at the assigned altitude at the current ETA for the assigned position without exceeding X feet per minute climb or descent (where X and Y values are defined in the VMLDB), the system alerts the pilot.

If the aircraft cannot cross the assigned position at or before the assigned time without an increase of X knots per second (where X is defined in the VMLDB), the system alerts the pilot.

If the aircraft passes (abeam) the assigned position after the assigned time or other than the assigned altitude, the system alerts the pilot.

Function Disarmed as Follows:

On pilot disarm selection at any time.

| 60 | CROSS [position] AT OR AFTER [time] AT [altitude] |
|---|---|

The system notes the assigned position, time, and altitude in this crossing constraint clearance, and monitors present position, ETA at the assigned position, current altitude, current time subsequent clearances.

If the aircraft cannot cross the assigned position at the assigned altitude at the current ATE for the assigned position without exceeding X feet per second climb or descent (where X is defined in the VMLDB), the system alerts the pilot.

If the aircraft cannot cross the assigned position at or after the assigned time without a decrease of X knots per second (where X is defined in the VMLDB), the system alerts the pilot.

If the aircraft passes the assigned position before the assigned time or at other than the assigned altitude, the system alerts the pilot.

Function Disarmed as Follows:

On pilot disarm selection at any time.

| 61 | CROSS [position] AT AND MAINTAIN [altitude] AT [Speed] |
|---|---|

The system notes the assigned position, speed, and altitude in this crossing constraint clearance, and monitors present position, ETA at assigned position, current altitude, current speed, current time and subsequent clearances.

If the aircraft cannot cross the assigned position at the assigned altitude and speed without exceeding X feet per second climb or descent (where X is defined in the VMLDB), the system alerts the pilot.

If the aircraft cannot cross the assigned position at the assigned altitude at the assigned speed without an increase of X knots per second or a decrease of Y knots per second (where X and Y values are defined in the VMLDB), the system alerts the pilot.

If the aircraft passes the assigned position and is not at the assigned altitude and speed, the system alerts the pilot.

If, after passing the assigned position and attaining the assigned altitude and speed, the MCP altitude is changed, a vertical rate of more than X feet per minute (where X is defined in the VMLDB) is sensed, or speed changes by more than Y knots (where Y is defined in the VMLDB), the system alerts the pilot.

Function Disarmed as Follows:

On pilot disarm selection at any time.

| 62 | AT [time] CROSS [position] AT AND MAINTAIN [altitude] |
|---|---|

The system notes the assigned position, time, and altitude in this crossing constraint clearance, and monitors present position, ETA at assigned position, current altitude, current time and subsequent clearances.

If the aircraft cannot cross the assigned position at the assigned altitude at the current ETA for the assigned position without exceeding X feet per minute climb or descent (where X values are defined in the VMLDB), the system alerts the pilot.

If the aircraft cannot cross the assigned position at the assigned time without changing speed at more than X knots per second (where X is defined in the VMLDB), the system alerts the pilot.

If the aircraft passes (abeam) the assigned position at other than the assigned time at the assigned altitude, the system alerts the pilot.

Function Disarmed as Follows:

On pilot disarm selection at any time.

| 63 | AT [time] CROSS [position] AT AND MAINTAIN [altitude] AT [Speed] |
|---|---|

The system notes the assigned position, time, speed and altitude in this crossing constraint clearance, and monitors present position, ETA at assigned position, current altitude, current speed, and current time.

If the aircraft cannot cross the assigned position at the assigned altitude and speed at the current ETA for the assigned position without exceeding X feet per minute climb or descent (where X is defined in the VMLDB), the system alerts the pilot.

If the aircraft cannot cross the assigned position at the assigned time, speed and altitude without an increase of X knots per second or a decrease of Y knots per second (where X and Y values are defined in the VMLDB), the system alerts the pilot.

If the aircraft cannot cross the assigned position at the assigned speed and altitude at the assigned time, the system alerts the pilot.

If the aircraft passes (abeam) the assigned position at other than the assigned time at the assigned, the system alerts the pilot.

Function Disarmed as Follows:

On pilot disarm selection at any time.

Lateral Offsets

| 64 | OFFSET [direction] [distanceOffset] OF ROUTE |
|---|---|

The system notes the assigned distance and direction of the offset in the offset clearance, and monitors current aircraft position, bearing of current route leg, and subsequent clearances.

If the current aircraft position is not at the assigned offset distance within X seconds of accepting the clearance (where X is defined in the VMLDB) the system alerts the pilot.

If the direction of offset is incorrect, the system alerts the pilot.

After the offset has been achieved, any variation in offset distance of more than Y miles (where Y is defined in the VMLDB) results in the system's alerting the pilot.

Function Disarmed as Follows:

On pilot disarm selection at any time.

| | |
|---|---|
| 65 | AT [position] OFFSET [direction] [distanceOffset] OF ROUTE |

The system notes the assigned position, distance and direction of the offset, and monitors current aircraft position, bearing of current route leg, and subsequent clearances.

If the aircraft starts the offset prior to reaching the assigned position, the system alerts the pilot.

If the aircraft does not achieve the assigned offset distance within X seconds after passing the assigned position (where X is defined in the VMLDB), the system alerts the pilot.

If the direction of offset is incorrect, the system alerts the pilot.

After the offset has been achieved, any variation in offset distance of more than Y miles (where Y is defined in the VMLDB) results in the system's alerting the pilot.

Function Disarmed as Follows:

On pilot disarm selection at any time.

| | |
|---|---|
| 66 | AT [time] OFFSET [direction] [distanceOffset] OF ROUTE |

The system notes the assigned time, distance and direction of the offset, and monitors current time, current position, bearing of the current route leg, and subsequent clearances.

If the aircraft starts the offset prior to the assigned time, the system alerts the pilot.

If the aircraft does not achieve the assigned offset distance within X seconds after the assigned time (where X is defined in the VMLDB) the system alerts the pilot.

If the direction of offset is incorrect, the system alerts the pilot.

After the offset has been achieved, any variation in offset distance of more than Y miles (where Y is defined in the VMLDB) results in the system's alerting the pilot.

Function Disarmed as Follows:

If a pre-alert is provided, this monitor function will still be active until passing the assigned position.

On pilot disarm selection at any time.

| | |
|---|---|
| 67 | PROCEED BACK ON ROUTE |

The system monitors current aircraft position and subsequent clearances.

If the current aircraft position is not within Y miles of the active route X seconds (where X and Y values are stored in the VMLDB), the system alerts the pilot.

Acceptance of the clearance disarms alert functions associated with route offset clearances.

Function Disarmed as Follows:

On pilot disarm selection at any time.

| | |
|---|---|
| 68 | REJOIN ROUTE BY [position] |

The system notes assigned position, current aircraft position, current aircraft track, route modifications, lateral navigation modes, and subsequent clearances.

If the aircraft's track is not changed to intercept the active route (no route modification made) at or prior to the assigned position before the aircraft is abeam the assigned position OR the route is not modified to take the aircraft directly to the assigned position and LNAV is engaged before the aircraft is abeam the assigned position, the system alerts the pilot.

If LNAV was active and subsequently de-activated, the system alerts the pilot.

Function Disarmed as Follows:

On pilot disarm selection at any time.

| | |
|---|---|
| 69 | REJOIN ROUTE BY [time] |

The system notes assigned time, current aircraft position, current heading, and distance off of the active route.

If the aircraft's track is not changed to intercept the active route (no route modification made) at or prior to the assigned time OR the route is not modified to take the aircraft directly to the assigned position and LNAV is engaged before the aircraft is abeam the assigned position, the system alerts the pilot.

If LNAV was active and subsequently de-activated, the system alerts the pilot.

Function Disarmed as Follows:

On pilot disarm selection at any time.

| | |
|---|---|
| 70 | EXPECT BACK ON ROUTE BY [position] |
| 71 | EXPECT BACK ON ROUTE BY [time] |

All are clearance expectations. Although these messages are included in the FANS message set, ATC controllers are discouraged from using them since flight crews might get confused and actually follow the "expect" message. Expectation messages are not monitored by COMPASS since no expect message can cause a violation.

Route Modifications

| | |
|---|---|
| 73 | [predeparturecleareance] |

If the assigned position and "routeclearance" data have not been loaded into the FMC X seconds after the clearance is accepted (where X is stored in the VMLDB), the system alerts the pilot.

| 74 | PROCEED DIRECT TO [position] |
|---|---|

The system notes the assigned position in the clearance and monitors the active waypoint position in the FMS and the state of the lateral navigation autopilot/flight director mode.

If the assigned position does not match the current active waypoint position in the FMS X seconds (where X is defined in the VMLDB) after the clearance has been accepted, the system alerts the pilot.

If LNAV is not active Y seconds after the clearance has been accepted (where Y is defined in the VMLDB), the system alerts the pilot.

If LNAV was active and subsequently de-activated, the system alerts the pilot.

Function Disarmed as Follows:

On pilot disarm selection at any time.

| 75 | WHEN ABLE PROCEED DIRECT TO [position] |
|---|---|

The system notes the assigned position in the clearance and monitors the active waypoint position in the FMS and the state of the lateral navigation autopilot/flight director mode.

If the assigned position does not match the current active waypoint position in the FMS X seconds (where X is stored in the VMLDB) after the clearance has been accepted, the system alerts the pilot.

If LNAV is not active Y seconds after the clearance has been accepted (where Y is stored in the VMLDB), the system alerts the pilot.

If LNAV was active and subsequently de-activated, the system alerts the pilot.

Note: the alert trigger values used for this clearance may be different than those used for message #74 since the pilot has some discretion on when to execute this clearance.

Function Disarmed as Follows:

On pilot disarm selection at any time.

| 76 | AT [time] PROCEED DIRECT TO [position] |
|---|---|

The system notes the assigned time and the assigned position in the clearance and monitors current time and the active waypoint position in the FMS and state of lateral navigation autopilot/flight director mode.

If the assigned position becomes the active waypoint position in the FMS prior to the time specified in the clearance the system alerts the pilot.

If the assigned position does not match the active waypoint position in the FMS X seconds after the time specified in the clearance (where X is stored in the VMLDB), the system alerts the pilot.

If LNAV is not active X seconds after the time specified in the clearance (where X is stored in the VMLDB), the system alerts the pilot.

If, after the assigned time, LNAV was active and subsequently de-activated, the system alerts the pilot.

Function Disarmed as Follows:

On pilot disarm selection at any time.

| 77 | AT [position] PROCEED DIRECT TO [position] |
|---|---|

The system notes the assigned "at" position and the "direct to" position in the clearance and monitors the current position and active waypoint position in the FMS and the state of lateral navigation autopilot mode.

If the "direct to" position becomes the current active waypoint position in the FMS before the aircraft passes (abeam) the "at" position specified in the clearance, the system alerts the pilot.

If the "direct to" position does not match the current active waypoint position in the FMS X seconds after the aircraft passes (abeam) the "at" position specified in the clearance (where X is stored in the VMLDB), the system alerts the pilot.

If LNAV is not active X seconds after the aircraft passes the "at" position specified in the clearance (where X is stored in the VMLDB), the system alerts the pilot.

If LNAV was active and subsequently de-activated, the system alerts the pilot.

Function Disarmed as Follows:

On pilot disarm selection at any time.

| 78 | AT [altitude] PROCEED DIRECT TO [position] |
|---|---|

The system notes the assigned altitude and the "direct to" position in the clearance and monitors the current altitude and active waypoint position in the FMS and the state of lateral navigation autopilot mode.

If the "direct to" position becomes the active waypoint position in the FMS before the aircraft reaches the specified altitude, the system alerts the pilot.

If the "direct to" position does not match the active waypoint position in the FMS X seconds (where X is stored in the VMLDB) after the aircraft reaches the specified altitude, the system alerts the pilot.

If LNAV is not active X seconds (where X is stored in the VMLDB) after the aircraft reaches the specified altitude, the system alerts the pilot.

If LNAV was active and subsequently de-activated, the system alerts the pilot.

Function Disarmed as Follows:

On pilot disarm selection at any time.

| 79 | CLEARED TO [position] VIA [routeclearance] |
|---|---|

The system notes the assigned position in the "cleared to via routeclearance" clearance and monitors the current altitude and active waypoint position in the FMS and the state of lateral navigation autopilot mode.

If the assigned position and "routeclearance" data have not been loaded into the FMC X seconds after the clearance is accepted (where X is stored in the VMLDB), the system alerts the pilot.

If LNAV is not active X seconds after the assigned position and "routeclearance" data are loaded into the FMC (where X is stored in the VMLDB), the system alerts the pilot.

If LNAV was active and subsequently de-activated, the system alerts the pilot.

| | |
|---|---|
| 80 | CLEARED [routeclearance] |

If "routeclearance" data have not been loaded into the FMC X seconds after the clearance is accepted (where X is stored in the VMLDB), the system alerts the pilot.

If LNAV is not active X seconds after the "routeclearance" data are loaded into the FMC (where X is stored in the VMLDB), the system alerts the pilot.

If LNAV was active and subsequently de-activated, the system alerts the pilot.

Function Disarmed as Follows:

On pilot disarm selection at any time.

| | |
|---|---|
| 81 | CLEARED [procedureName] |

If the "procedureName" data have not been loaded into the FMC X seconds after acceptance (where X is stored in the VMLDB), the system alerts the pilot.

If LNAV is not active X seconds after loading the "procedureName" element (where X is stored in the VMLDB), the system alerts the pilot.

If LNAV was active and subsequently de-activated, the system alerts the pilot.

| | |
|---|---|
| 83 | AT [position] CLEARED [routeclearance] |

If the "routeclearance" data have not been loaded into the FMC X seconds after acceptance (where X is stored in the VMLDB), the system alerts the pilot.

If LNAV is not active X seconds, after the "routeclearance" data are loaded into the FMC (where X is stored in the VMLDB), the system alerts the pilot.

If LNAV was active and subsequently de-activated, the system alerts the pilot.

Function Disarmed as Follows:

On pilot disarm selection at any time.

| | |
|---|---|
| 84 | AT [position] CLEARED [procedureName] |

If the "procedureName" data have not been loaded into the FMC X seconds after acceptance (where X is stored in the VMLDB), the system alerts the pilot.

If LNAV is not active X seconds after the "procedureName" data are loaded into the FMC (where X is stored in the VMLDB), the system alerts the pilot.

If LNAV was active and subsequently de-activated, the system alerts the pilot.

Function Disarmed as Follows:

On pilot disarm selection at any time.

| | |
|---|---|
| 85 | EXPECT [routeclearance] |
| 86 | AT [position] EXPECT [routeclearance] |
| 88 | AT [position] EXPECT DIRECT TO [position] |
| 89 | AT [time] EXPECT DIRECT TO [position] |
| 90 | AT [altitude] EXPECT DIRECT TO [position] |

All are clearance expectations. Although these messages are included in the FANS message set, ATC controllers are discouraged from using them since flight crews might get confused and actually follow the "expect" message. Expectation messages are not monitored by COMPASS since no expect message can cause a violation.

| | |
|---|---|
| 91 | HOLD AT [position] MAINTAIN [altitude] INBOUND TRACK [degrees]/[direction] TURN LEGTIME [legType] |
| 92 | HOLD AT [position] AS PUBLISHED MAINTAIN [altitude] |

If the "hold at position" data have not been loaded into the FMC X seconds after acceptance (where X is stored in the VMLDB), the system alerts the pilot.

If LNAV is not active X seconds after the "procedureName" data are loaded into the FMC (where X is stored in the VMLDB), the system alerts the pilot.

If LNAV was active and subsequently de-activated, the system alerts the pilot.

Function Disarmed as Follows:

On pilot disarm selection at any time.

| | |
|---|---|
| 93 | EXPECT FURTHER CLEARANCE AT [time] |
| 99 | EXPECT [procedureName] |

All are clearance expectations. Although these messages are included in the FANS message set, ATC controllers are discouraged from using them since flight crews might get confused and actually follow the "expect" message. Expectation messages are not monitored by COMPASS since no expect message can cause a violation.

| | |
|---|---|
| 94 | TURN [direction] HEADING [degrees] |
| 95 | TURN [direction] GROUND TRACK [degrees] |

These clearances direct the pilot to turn to a specific heading or ground track in a specific direction. The system notes assigned direction and heading or ground track and monitors MCP heading/track, current heading or ground track, and rate of change of heading/track.

If the assigned heading or ground track is not entered into the MCP heading window in the assigned direction within X seconds of acceptance of the clearance (where X is defined in VMLDB), the system alerts the pilot.

If "Heading Select" mode of the autopilot/flight director is not engaged within Y seconds of acceptance of the clearance (where Y is defined in VMLDB), the system alerts the pilot.

If the current heading or ground track changes in a direction opposite to the assigned direction, the system alerts the pilot.

If the aircraft does not roll out (rate of change of heading is zero) on a heading within Z degrees of the assigned heading (where Z is defined in the VMLDB), the system alerts the pilot.

Function Disarmed as Follows:

On pilot disarm selection at any time.

| 96 | FLY PRESENT HEADING |
|---|---|

This clearance directs the pilot to maintain the present heading at time of clearance transmission. It is assumed that the clearance will be issued while the aircraft is on a steady heading, but functionality accommodates cases where the clearance is received while the aircraft is in a turn. The system notes current heading at the time of acceptance and monitors current heading.

If current heading changes from the assigned heading (heading value at time of acceptance) by more than X degrees (where X is defined in VMLDB), the system alerts the pilot.

Function Disarmed as Follows:

On pilot disarm selection at any time.

| 97 | AT [position] FLY HEADING [degrees] |
|---|---|

This clearance directs the pilot to fly an assigned heading after passing an assigned position. The system notes the assigned position and assigned heading and monitors current position and current heading.

If the assigned position is deleted from the active route in the FMC before the aircraft passes (abeam) the position, the system alerts the pilot.

If current heading does not equal the assigned heading X seconds (where X is defined in VMLDB) after the aircraft passes (abeam) the assigned position, the system alerts the pilot.

Function Disarmed as Follows:

On pilot disarm selection at any time.

| 98 | IMMEDIATELY TURN [direction] HEADING [degrees] |
|---|---|

This clearance directs the pilot to immediately turn to a specific heading in a specific direction. The system notes assigned heading and assigned direction of turn and monitors MCP heading, current heading, and rate of change of heading.

If the assigned heading has not been entered into the MCP heading window in the assigned direction X seconds (where X is defined in VMLDB) after acceptance of the clearance, the system alerts the pilot.

If "Heading Select" mode of the autopilot/flight director is not engaged within Y seconds of acceptance of the clearance (where Y is defined in VMLDB), the system alerts the pilot.

If the current heading changes in a direction opposite to the assigned direction, the system alerts the pilot.

If the aircraft does not roll out (rate of change of heading is zero) on a heading within Z degrees of the assigned heading (where Z is defined in the VMLDB), the system alerts the pilot.

Function Disarmed as Follows:

On pilot disarm selection at any time.

| 178 | Undefined (previously TRACK DETAIL MESSAGE) |
|---|---|

This message is used to facilitate transmission of route information between ATC facilities through the aircraft. Therefore, no COMPASS monitoring logic is required.

Speed Changes

| | |
|---|---|
| 100 | AT [time] EXPECT [speed] |
| 101 | AT [position] EXPECT [speed] |
| 102 | AT [altitude] EXPECT [speed] |
| 103 | AT [time] EXPECT [speed] TO [speed] |
| 104 | AT [position] EXPECT [speed] TO [speed] |
| 105 | AT [altitude] EXPECT [speed] TO [Speed] |

All are clearance expectations. Although these messages are included in the FANS message set, ATC controllers are discouraged from using them since flight crews might get confused and actually follow the "expect" message. Expectation messages are not monitored by COMPASS since no expect message can cause a violation.

| | |
|---|---|
| 106 | MAINTAIN [speed] |
| 107 | MAINTAIN PRESENT SPEED |
| 108 | MAINTAIN [speed] OR GREATER |
| 109 | MAINTAIN [speed] OR LESS |
| 110 | MAINTAIN [speed] TO [speed] |

These messages are all "maintain speed" clearance messages. The system notes the speed, or speed range, in the clearance, and monitors current speed.

If the current speed does not match the assigned speed, or speed range as defined in the clearance X seconds (where X is defined in the VMLDB) after the clearance has been accepted, the system alerts the pilot.

Function Disarmed as Follows:

On pilot disarm selection at any time.

| | |
|---|---|
| 111 | INCREASE SPEED TO [speed] |
| 112 | INCREASE SPEED TO [speed] OR GREATER |
| 113 | REDUCE SPEED TO [speed] |
| 114 | REDUCE SPEED TO [speed] OR LESS |

These messages are all speed change clearance messages. The system notes the assigned speed, instruction to increase or decrease, and current aircraft speed.

If the current speed does not match the assigned speed or speed range X seconds (where X is defined in the VMLDB) after the clearance has been accepted, the system alerts the pilot.

Function Disarmed as Follows:

On pilot disarm selection at any time.

| | |
|---|---|
| 115 | DO NOT EXCEED [speed] |

The system notes the assigned speed in the speed instruction and monitors current speed and rate of change of speed.

If the current aircraft speed exceeds the assigned speed, the system alerts the pilot.

If the aircraft will exceed the assigned speed within X seconds (X is defined in the VMLDB) at the current rate of change of speed, the system alerts the pilot.

Function Disarmed as Follows:

On pilot disarm selection at any time.

| | |
|---|---|
| 116 | RESUME NORMAL SPEED |

This clearance removes all speed restrictions. All speed monitoring logic is canceled.

Contact/Monitor/Surveillance Requests

| | |
|---|---|
| 117 | CONTACT [icaoUnitName] [frequency] |
| 118 | AT [position] CONTACT [icaoUnitName] [frequency] |
| 119 | AT [time] CONTACT [iceoUnitName] [frequency] |

These messages are all instructions for the pilot to establish voice contact with the assigned facility. The system notes the frequency in the contact instruction and all active frequencies selected on VHF and HF radios selected to the voice mode.

If the frequency in the contact message has not been entered into one of the radio tuning control heads within X seconds (where X is defined in the VMLDB) of acceptance of the instruction, the system alerts the pilot.

Function Disarmed as Follows:

On pilot disarm selection at any time.

| | |
|---|---|
| 120 | MONITOR [icaoUnitName] [frequency] |
| 121 | AT [position] MONITOR [icaoUnitName] [frequency] |
| 122 | AT [time] MONITOR [icaoUnitName] [frequency] |

These messages are all instructions for the pilot to monitor the frequency assigned in the uplink. The system notes the frequency in the monitor instruction and all active frequencies selected on VHF and HF radios selected to the voice mode.

If the frequency in the monitor message has not been entered into one of the radios tuning control heads X seconds (where X is defined in the VMLDB) after acceptance of the instruction, the system alerts the pilot.

Function Disarmed as Follows:

On pilot disarm selection at any time.

| | |
|---|---|
| 124 | STOP SQUAWK |
| 125 | SQUAWK ALTITUDE |
| 126 | STOP ALTITUDE SQUAWK |
| 179 | SQUAWK IDENT |

These messages are all instructions to set the ATC transponder to a specific mode. The system notes the mode assigned in the instruction and all current ATC transponder modes.

If the current ATC transponder mode does not equal the assigned mode X seconds (where X is defined in the VMLDB) after acceptance of the instruction, the system alerts the pilot.

Function Disarmed as Follows:

On pilot disarm selection at any time.

Report/Confirmation Requests

| | | |
|---|---|---|
| 127 | REPORT BACK ON ROUTE | 41 |
| 128 | REPORT LEAVING [altitude] | 28 |
| 129 | REPORT LEVEL [altitude] | 37 |
| 130 | REPORT PASSING [position] | 31 |
| 131 | REPORT REMAINING FUEL AND SOULS ON BOARD | 57 |
| 175 | REPORT REACHING [altitude] | 72 |
| 180 | REPORT REACHING BLOCK [altitude] TO [altitude] | 76 |
| 181 | REPORT DISTANCE [tofrom][position] | 78 |

These messages are all requests by the controller for the pilot to report a requested parameter. The system notes the report request message number in the report request and monitors the associated downlink report response.

If the associated response message has not been sent within X seconds of the assigned reporting action (where X is defined in the VMLDB), the system alerts the pilot. Requirements for assigned reporting action are defined as follows:

UL#127—lateral offset from active route reduces to X nautical miles

UL#128—current altitude deviates from assigned altitude by Y feet

UL#129—report required within T seconds of receipt of the request

UL#130—aircraft passes (abeam) assigned position

UL#131—report required within T seconds of receipt of the request

UL#175—aircraft levels at or passes through assigned altitude

UL#180—aircraft levels at or passes through closest altitude in assigned altitude block UL#181—report required within T seconds of receipt of the request Function Disarmed as Follows:

On pilot disarm selection at any time.

| | | |
|---|---|---|
| 132 | CONFIRM POSITION | 33 |
| 133 | CONFIRM ALTITUDE | 32 |

-continued

| | | |
|---|---|---|
| 134 | CONFIRM SPEED | 34 |
| 135 | CONFIRM ASSIGNED ALTITUDE | 38, 77 |
| 136 | CONFIRM ASSIGNED SPEED | 39 |
| 137 | CONFIRM ASSIGNED ROUTE | 40 |
| 138 | CONFIRM TIME OVER REPORTED WAYPOINT | 46 |
| 139 | CONFIRM REPORTED WAYPOINT | 45 |
| 140 | CONFIRM NEXT WAYPOINT | 42 |
| 141 | CONFIRM NEXT WAYPOINT ETA | 43 |
| 142 | CONFIRM ENSUING WAYPOINT | 44 |
| 143 | CONFIRM REQUEST | mult |
| 144 | CONFIRM SQUAWK | 47 |
| 145 | CONFIRM HEADING | 35 |
| 146 | CONFIRM GROUND TRACK | 36 |
| 147 | REQUEST POSITION REPORT | 48 |
| 182 | CONFIRM ATIS CODE | 79 |

These messages are all requests by the controller for the pilot to confirm a requested parameter. The system notes the confirmation request and the associated downlink response message number.

If the associated response downlink message has not been sent within X seconds (where X is defined in the VMLDB), the system alerts the pilot.

Function Disarmed as Follows:

On pilot disarm selection at any time.

Negotiation Requests

| | | |
|---|---|---|
| 148 | WHEN CAN YOU ACCEPT [altitude] | 67b, 67e |
| 149 | CAN YOU ACCEPT [altitude] AT [position] | N/A |
| 150 | CAN YOU ACCEPT [altitude] AT [time] | N/A |
| 151 | WHEN CAN YOU ACCEPT [speed] | 67c, 67f |
| 152 | WHEN CAN YOU ACCEPT [direction] [distanceOffset] OFFSET | 67d, 67g |

Controllers use these messages to query flight crew as to the acceptance of certain clearances. These messages are not monitored by COMPASS since none of these messages can cause a violation Air Traffic Advisories

| | |
|---|---|
| 153 | ALTIMETER [altimeter] |

The system notes the assigned altimeter setting in the clearance and monitors current aircraft altimeter setting.

If the aircraft altimeter setting does not equal the cleared altimeter setting X seconds (where X is defined the VMLDB) after the instruction is accepted, the system alerts the pilot.

Function Disarmed as Follows:

On pilot disarm selection at any time.

| | |
|---|---|
| 154 | RADAR SERVICES TERMINATED |
| 155 | RADAR CONTACT [position] |
| 156 | RADAR CONTACT LOST |

-continued

| | |
|---|---|
| 157 | CHECK STUCK MICROPHONE [frequency] |
| 158 | ATIS [atisCode] |

These messages are all advisory messages for the crew. No COMPASS logic is required.

System Management Messages

| | |
|---|---|
| 159 | ERROR [errorinformation] |
| 160 | NEXT DATA AUTHORITY [icaofacilitydesignation] |
| 161 | END SERVICE |
| 162 | SERVICE UNAVAILABLE |
| 163 | [icaoFacilityDesignation] [tp4Table] |

These messages are used to facilitate connection transfers and connection management. Therefore, no COMPASS monitoring logic is required.

Additional Messages

| | |
|---|---|
| 164 | WHEN READY |
| 165 | THEN |
| 166 | DUE TO TRAFFIC |
| 167 | DUE TO AIRSPACE RESTRICTION |
| 168 | DISREGARD |
| 169 | [freetext] |
| 170 | [freetext] |
| 176 | MAINTAIN OWN SEPARATION AND VMC |
| 177 | AT PILOTS DISCRETION |

These messages are generally used in conjunction with other messages to create the desired clearance. Therefore, no specific COMPASS monitoring logic is required for these specific messages.

Automatic Dependent Surveillance

Automatic Dependent Surveillance

The Automatic Dependent Surveillance system allows ATC to monitor flight conformance. With the use of event triggers, ATC can monitor vertical deviation, vertical rate change, lateral deviation, and waypoint changes for clearance conformance and flight plan consistency monitoring.

COMPASS notes all ADS event contracts and their trigger conditions.

If the current altitude comes within X feet of the ADS vertical deviation event trigger (where X is stored in the VMLDB), the system alerts the pilot.

If the current vertical rate comes within X feet of the ADS vertical rate event trigger (where X is stored in the VMLDB), the system alerts the pilot.

If the current cross track error comes within X nautical miles of the ADS lateral deviation event trigger (where X is stored in the VMLDB), the system alerts the pilot.

Variable Monitoring Logic Data Base Definition

In order to monitor aircraft conformance to cleared flight path, the COMPASS system needs access to specific aircraft parameters. In many cases these are the same parameters, which the flight crew use to monitor flight path conformance. The table below defines the generic parameters required by COMPASS to monitor flight conformance.

Altitude
Current baro corrected altitude/
Current uncorrected altitude
Current vertical rate—climb/descent
Current Autopilot Mode Control Panel set altitude
Position
Current latitude
Current longitude
Cross track angle
Required Navigation Performance/Value
Speed
Current airspeed/Mach
Current ground speed
Current wind—speed/track
Flight Management Computer
Active waypoint
Waypoint sequenced
Next waypoint/dist/est time/track/
Next +1 waypoint/dist/est time/track
Distance off of active route
Current cross track error
Route loading status
Partial clearance loaded
Route not loaded
Route load valid
Vertical performance values
Lateral Navigation engage status
Vertical Navigation engage status
Autopilot Modes
LNAV engage/manual
VNAV engage/manual
Heading select engage/value
Vertical speed engage/value
Speed mode engage/value
Approach mode engage
Auto-pilot engage
Flight director engage
Auto-throttle engage
Auto-throttle mode
Communications
VHF frequency/value for left, center, and right radios
HF frequency/value for the left and right radios
Automatic Dependent Surveillance
Vertical deviation event contract/value
Vertical rate change event contract/value
Lateral deviation event/value
Waypoint sequence event trigger/waypoint While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination in the method of operating a data link clearance alerting system:

manually or automatically enabling the data link clearance alerting system upon establishing a data link connection with air traffic control;

said air traffic control providing a plurality of ATC clearances;

storing each of said ATC clearance positively acknowledged and accepted;

monitoring the aircraft in relation to the clearance; and providing an alert prior to or as soon as the aircraft is not in compliance with a clearance.

2. A data link clearance monitoring and alerting system comprising in combination:

an interface with the aircraft's data link communications system;

a data monitoring system;

a clearance data system;

a variable monitoring logic database;

a compass function system;

said compass function system responsive to said data monitoring system, said clearance data system, and said variable monitoring logic database for providing an aural alert, visual alert, and an output to said aircraft's data link communication system to enable display of triggering messages.

3. The invention according to claim 2 wherein said data monitoring system is responsive to ATC data link clearances, report requests and pilot data link responses.

4. The invention according to claim 2 wherein said variable monitoring logic database includes modifiable trigger parameters.

5. The invention according to claim 2 wherein said data monitoring system is responsive to current altitude, vertical rate, current speed, current position, next active waypoint, next +1 waypoint, next +2 waypoint, current UTC time, offset direction and distance, current heading, current ground track, radio frequencies, and beacon code.

* * * * *